US010352085B1

(12) United States Patent
Shaoul

(10) Patent No.: US 10,352,085 B1
(45) Date of Patent: Jul. 16, 2019

(54) MOTORIZED WINDOW VENTING INSERT

(71) Applicant: Michael Shaoul, New York, NY (US)

(72) Inventor: Michael Shaoul, New York, NY (US)

( * ) Notice: Subject to any disclaimer, the term of this patent is extended or adjusted under 35 U.S.C. 154(b) by 224 days.

(21) Appl. No.: 15/599,619

(22) Filed: May 19, 2017

(51) Int. Cl.

| | |
|---|---|
| ***E05F 15/71*** | (2015.01) |
| ***F24F 7/013*** | (2006.01) |
| ***E05F 15/77*** | (2015.01) |
| *E05F 15/652* | (2015.01) |
| *E05F 15/70* | (2015.01) |
| *E05F 15/659* | (2015.01) |

(52) U.S. Cl.
CPC ..... *E05F 15/71* (2015.01); *E05F 15/77* (2015.01); *F24F 7/013* (2013.01); *E05F 15/652* (2015.01); *E05F 15/659* (2015.01); *E05F 15/70* (2015.01)

(58) Field of Classification Search
CPC ... E06B 7/02; F24F 7/013; E05F 15/71; E05F 15/77; E05F 15/659; E05F 15/70; E05F 15/652
See application file for complete search history.

(56) References Cited

U.S. PATENT DOCUMENTS

| | | | | |
|---|---|---|---|---|
| 2,678,212 A | | 5/1954 | Flostroy | |
| 3,330,071 A | * | 7/1967 | Kubisiak | E05F 11/40 49/362 |
| 4,453,456 A | * | 6/1984 | Szkudlarek | E06B 7/03 160/89 |
| RE34,334 E | * | 8/1993 | Chaney | F04D 25/10 454/210 |
| 5,382,136 A | * | 1/1995 | Wang | F04D 25/12 416/247 R |
| 5,605,013 A | | 2/1997 | Hogston | |
| 5,743,709 A | * | 4/1998 | Jane | F04D 25/105 415/125 |
| 6,579,169 B1 | * | 6/2003 | Demark | E06B 7/02 454/200 |
| 7,032,348 B1 | * | 4/2006 | Epps | E05F 15/74 49/25 |
| 9,476,249 B2 | * | 10/2016 | Kim | E06B 7/10 |
| 2009/0193717 A1 | | 8/2009 | Ebbe et al. | |
| 2011/0232193 A1 | | 9/2011 | Thorne | |
| 2013/0318875 A1 | * | 12/2013 | Hansen | E05F 15/665 49/349 |
| 2016/0340959 A1 | * | 11/2016 | Valinejadshoubi | H04L 12/2816 |

FOREIGN PATENT DOCUMENTS

| | | |
|---|---|---|
| EP | 1707726 | 10/2006 |
| WO | WO03042480 | 5/2003 |

* cited by examiner

*Primary Examiner* — Justin B Rephann
(74) *Attorney, Agent, or Firm* — Goldstein Law Offices, P.C.

(57) ABSTRACT

A window venting insert, including a main housing, for use within a window assembly having a casement an upper window panel and a lower window panel, the lower window panel may be opened to create a window opening. A screen panel extends within the main housing an allows air flow through the main housing. A movable solid panel has a closed position where it selectively blocks the screen panel to prevent air flow therethrough. A motor mechanism and a control unit cooperate to determine appropriate times and ambient temperatures for moving the movable solid panel to the closed position.

16 Claims, 19 Drawing Sheets

MOTORIZED WINDOW VENTING INSERT

TECHNICAL FIELD

The present disclosure relates generally to a motorized window venting insert. More particularly, the present disclosure relates to an insert that installs into a window frame in the place of a window screen, and provides automated and motorized selective venting of the window.

BACKGROUND

Most conventional windows are designed to open to allow ventilation when desired and to close when necessary to keep out bad weather. Such windows are generally designed to allow a window screen to be installed onto the window frame, so that the window may be opened for ventilation while preventing insects from flying or crawling in through the open window.

In most climates, the temperature will change considerably throughout a typical 24 hour day/night cycle. Frequently this means the windows in a dwelling may be opened and closed at various times during the day to suit the comfort of the occupant.

It is quite common in warmer climates and during the summer in temperate climates to open a bedroom window before retiring for the night. When a large temperature drop occurs during the night, however, the interior temperature can also drop to undesirable levels. The sleeping occupant may be slow to respond, and therefore eventually wake to a house that is way too cold.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a venting device that allows a user to enjoy the benefits of an open window, without the drawbacks. Accordingly, the present disclosure provides a venting device that selectively installs within a window opening of a dwelling to allow free air flow through the window opening, and appropriately closes the window opening to prevent cold air or moisture from entering the dwelling.

It is another aspect of an example embodiment in the present disclosure to provide a venting device that will close the window opening to stop air flow, even when unattended. Accordingly the window venting device has a temperature sensor for sensing the ambient temperature and has a closing temperature setting. When the closing temperature is reached, the window opening is automatically closed. The window venting device may also have a closing time setting, such that the device is set to close at a user selectable time.

It is yet another aspect of an example embodiment to provide a window venting device that effectively controls air flow. Accordingly, the venting device has a screen panel for freely allowing air flow through the window opening, and has a movable solid panel that is movable under motor control to selectively block the screen panel and reduce or prevent air flow therethrough.

It is a further aspect of an example embodiment in the present disclosure to provide a venting device that secures the window assembly and prevents theft or unauthorized entry into the dwelling through the window opening. Accordingly, external and internal protector panels prevent the venting device from being pushed into the dwelling. A jack device may be placed between the lower window panel and casement top to prevent the lower window panel from being moved vertically, free of the protector panels.

It is still a further aspect of an example embodiment in the present disclosure to provide a venting device that is conveniently controllable by the user. Accordingly, front panel controls allow the venting device to be opened or closed at will. A wireless sensor allows the device to be controlled by a remote control device, as well as by interfacing with smartphones or other portable electronic devices.

Accordingly, the present disclosure describes a window venting insert, including a main housing, for use within a window assembly having a casement, an upper window panel and a lower window panel, the lower window panel may be opened to create a window opening. A screen panel extends within the main housing an allows air flow through the main housing. A movable solid panel has a closed position where it selectively blocks the screen panel to prevent air flow therethrough. A motor mechanism and a control unit cooperate to determine appropriate times and ambient temperatures for moving the movable solid panel to the closed position.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
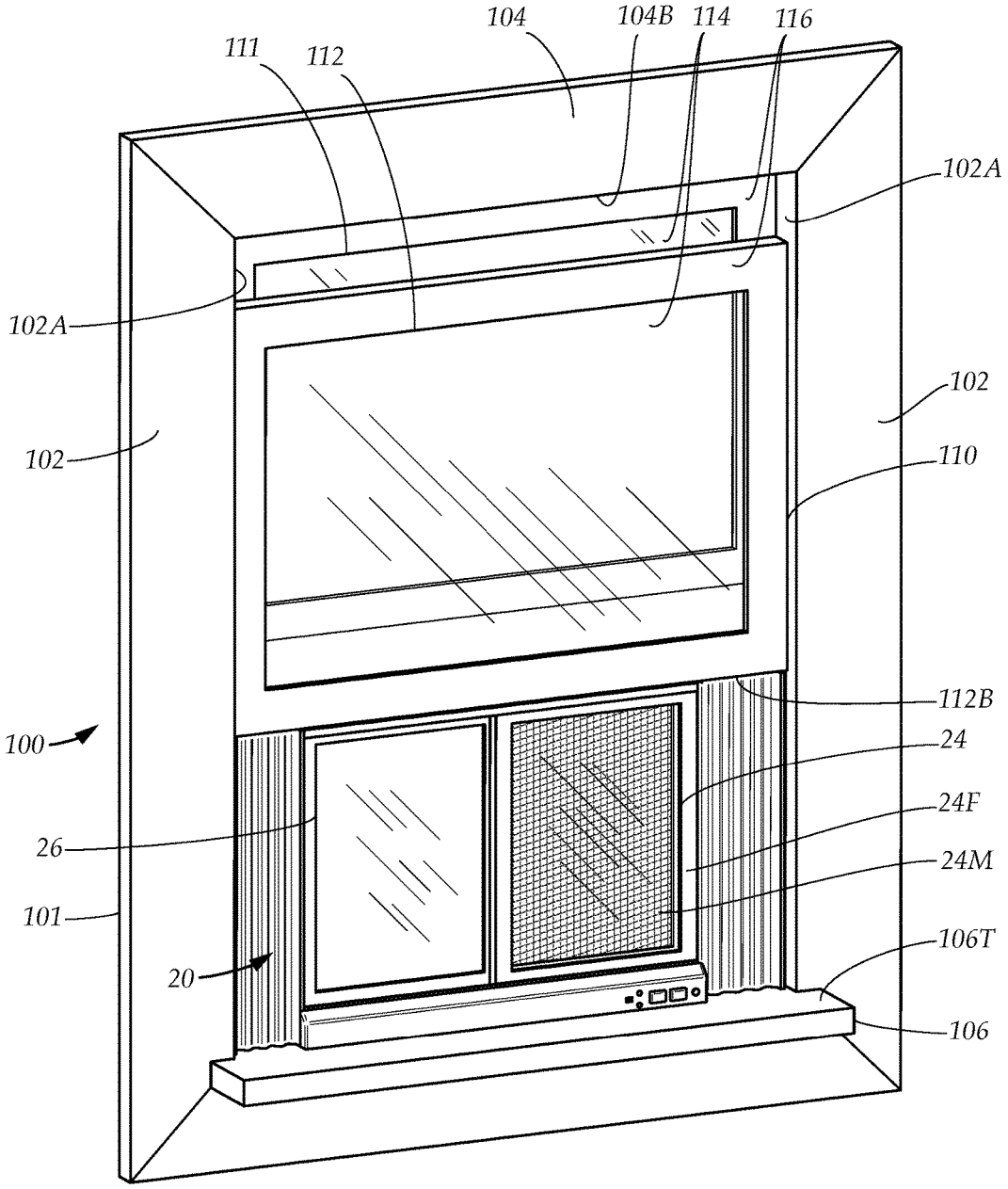
FIG. 1 is a diagrammatic perspective view, showing a first embodiment of a window venting insert, installed within a window casement.

FIG. 1 illustrates a window assembly 100, including a casement 101, including a pair of casement sides 102, each having an inner surface 102A, a casement top 104 having a bottom surface 104B, and a casement sill 106 having a top surface 106T. A window 110 is mounted within the window casement 100, including an upper window panel 111 and a lower window panel 112. The lower panel 112 is movable. In particular, the type of window illustrated is a double hung window. Each of the window panels 111, 112 has a glass panel 114, and a window frame 116 that encloses the glass panel 114 on four sides. The window frame 116 for the lower panel 112 has a bottom edge 112B. The window 110 can be selectively closed, wherein the entire space between the casement sides 102, casement top 104, and casement sill 106 is spanned by the window panels 111, 112; and can be open, wherein the lower panels 112 is moved upwardly to create a window opening defined by the casement sides 102, the casement sill 106, and the bottom edge 112B of the lower panel 112.

Figure 2:
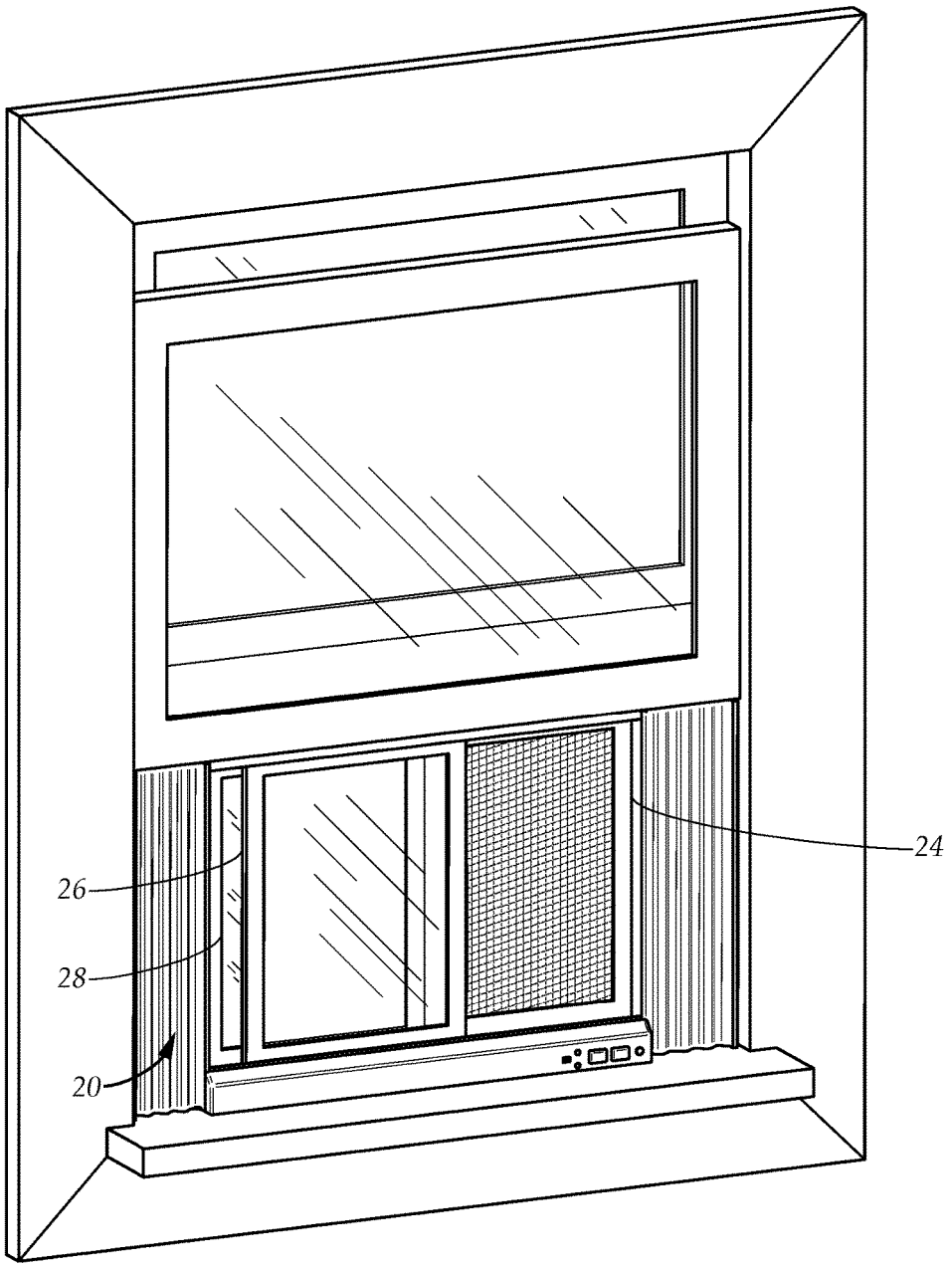
FIG. 2 is a diagrammatic perspective view, similar to FIG. 1, except wherein a movable panel is partially blocking a screen portion of the window venting insert.

Referring still to FIG. 1, a window venting insert 20 is shown positioned within the window assembly, extending between the casement sides 102, the casement sill 106, and the bottom edge 112B of one of the lower panels 112. Accordingly, the window venting insert 20 substantially spans the window opening. The window venting insert 20 includes a screen panel 24 and a solid movable panel 26. The screen panel 24 has a screen panel frame 24F and a mesh covering 24M that extends within and spans the screen panel frame 24F. The screen panel 24 selectively allows ventilation though the window venting insert 20. Air flow through the screen panel 24 may be partially or fully blocked, however, by the solid movable panel 26. For example, referring to FIG. 2, the solid movable panel 26 is partially blocking the screen panel 24 and thus is effectively reducing air flow through the window venting insert 20. Also seen in FIG. 2 is a solid fixed panel 28 that is positioned side by side with the screen panel 24. When the window venting insert 20 is fully open, the solid movable panel 26 is aligned directly in front of the solid fixed panel 28. When the window venting insert 20 is fully closed, however, the solid movable panel 26 is positioned substantially alongside the solid fixed panel 28, yet slightly overlapping and offset slightly forward therefrom.

Figure 3:
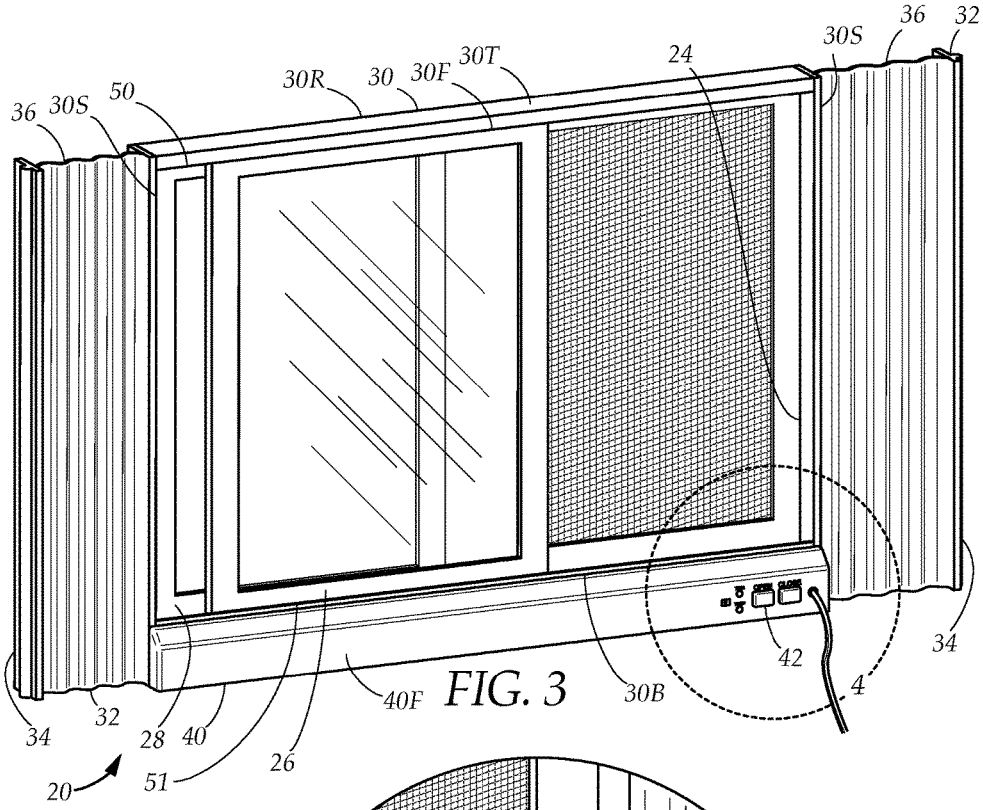
FIG. 3 is a diagrammatic perspective view, showing the window venting insert, per se.

Referring to FIG. 3, the window venting insert 20 has a main housing 30 having a front 30F, a rear 30R, a top 30T, a bottom 30B, and two side edges 30S. A pair of side extenders 32 extend from each of the side edges 30S and each include a sealing member 34 and an accordion panel 36. The side extenders 32 allow the window venting insert 20 to adjust to different window casement widths, wherein the accordion panels 36 extend and retract as needed to span between the casement and the side edges 30S of the main housing 30. The main housing 30 has a top track 50 and a bottom track 51. The top track 50 is located at and defines the top 30T of the main housing 30 and the bottom track 51 is located at and defines the bottom 30B of the main housing 30. The screen panel 24, the solid movable panel 26, and the solid fixed panel 28 all extend fully between the top track 50 and bottom track 51. The solid fixed panel 28 and screen panel 24 are both fixed in position therein, and the solid movable panel 26 is capable of slidable movement, laterally between the side edges 30S.

Figure 4:
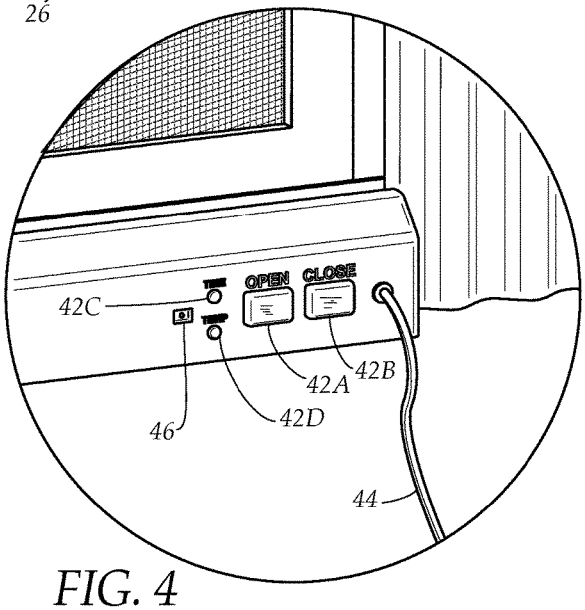
FIG. 4 is an enlarged view, showing the area indicated by circle 4 in FIG. 3, illustrating user controls of the window venting insert.

The window venting insert 20 also has a lower housing 40 that sits immediately below the main housing 30. The lower housing 40 preferably houses a control unit 60 (seen in FIG. 8) capable of orchestrating the functionality described herein and also has a front panel 40F having operational control buttons 42. Referring to the enlargement of the lower housing 40 shown in FIG. 4, the control buttons 42 may include an open button 42A, a close button 42B, a time set button 42C, and a temperature set button 42D. In addition, a power cord 44 can be provided to allow the insert 20 to be powered by an external power source such as a wall outlet. Alternatively, a battery unit 45 (seen in FIG. 8) may be provided within the lower housing 40 to power the unit and/or provide a battery back up to the control unit, clock and temperature settings and/or mechanical operation of the insert 20 as will be described in further detail hereinafter. Further, a wireless sensor 46 may be provided on the front panel 40F of the lower housing 40. The wireless sensor 46 may be configured for receiving infrared signals for operating and/or programming the control unit, and may be configured as a transducer for communicating with an external device via RF signals, using a communication protocol such as WiFi, BLUETOOTH, or the like.

Figure 5:
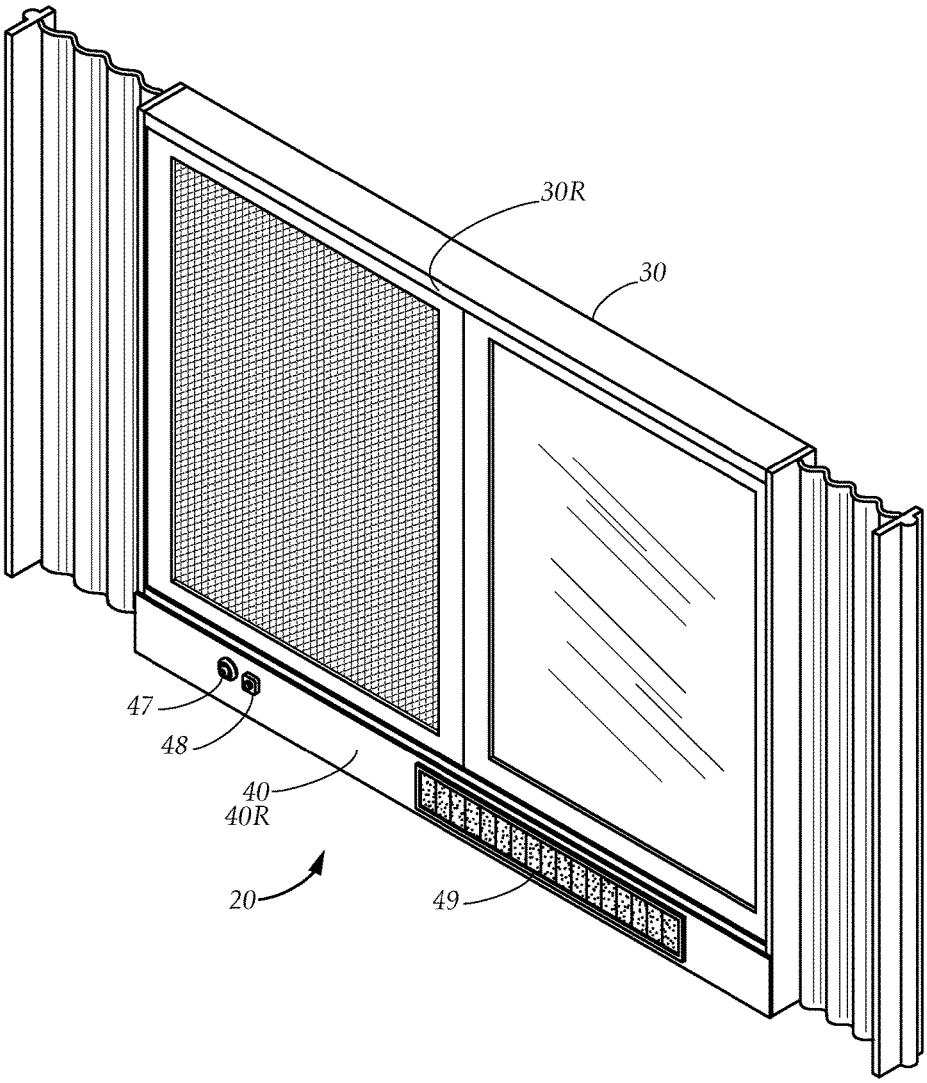
FIG. 5 is a diagrammatic perspective view, showing external features of the window venting insert.

FIG. 5 illustrates an external portion of the window venting insert 20, showing the rear 30R of the main housing 30, and also the lower housing 40 having a rear 40R. In particular, on the rear 40R of the lower housing 40 is a rain sensor 47 for sensing moisture, a temperature sensor 48 for sensing ambient temperature, and a solar panel 49. The solar panel can be used for powering the insert 20 directly and/or by charging batteries within the insert 20.

Figure 6:
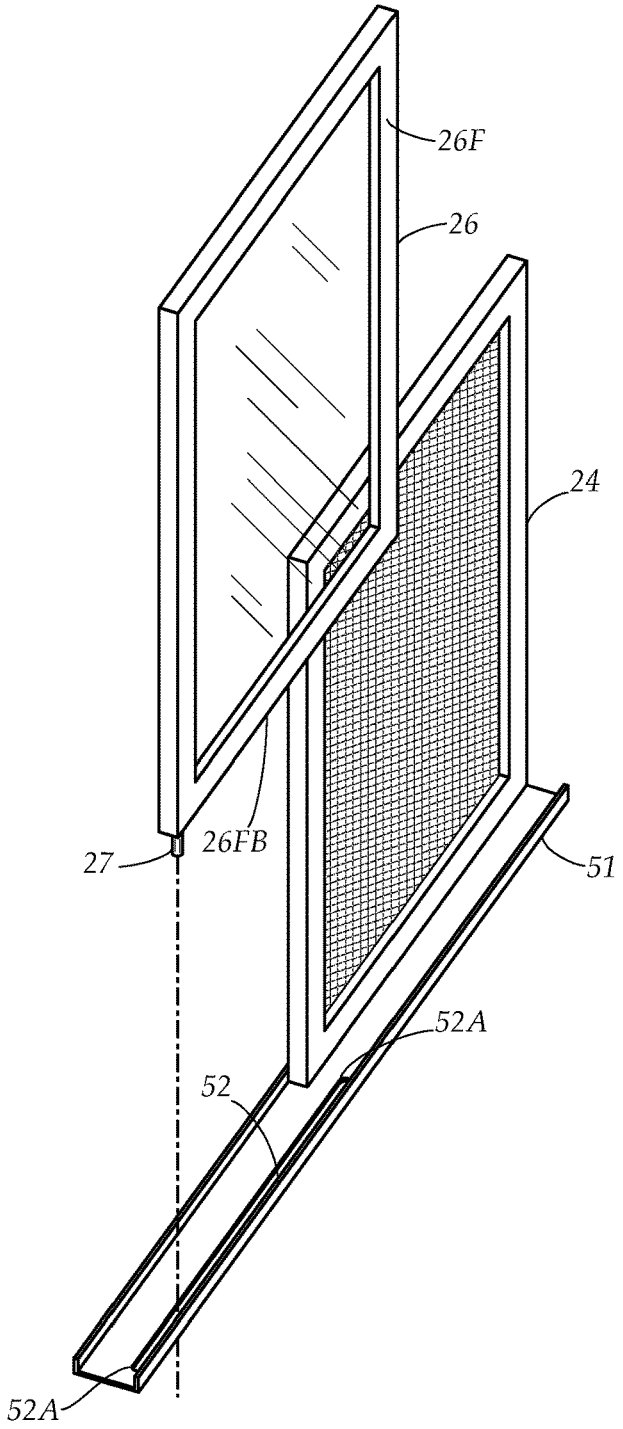
FIG. 6 is an exploded view, illustrating operative components of the window venting insert.
Figure 7A:
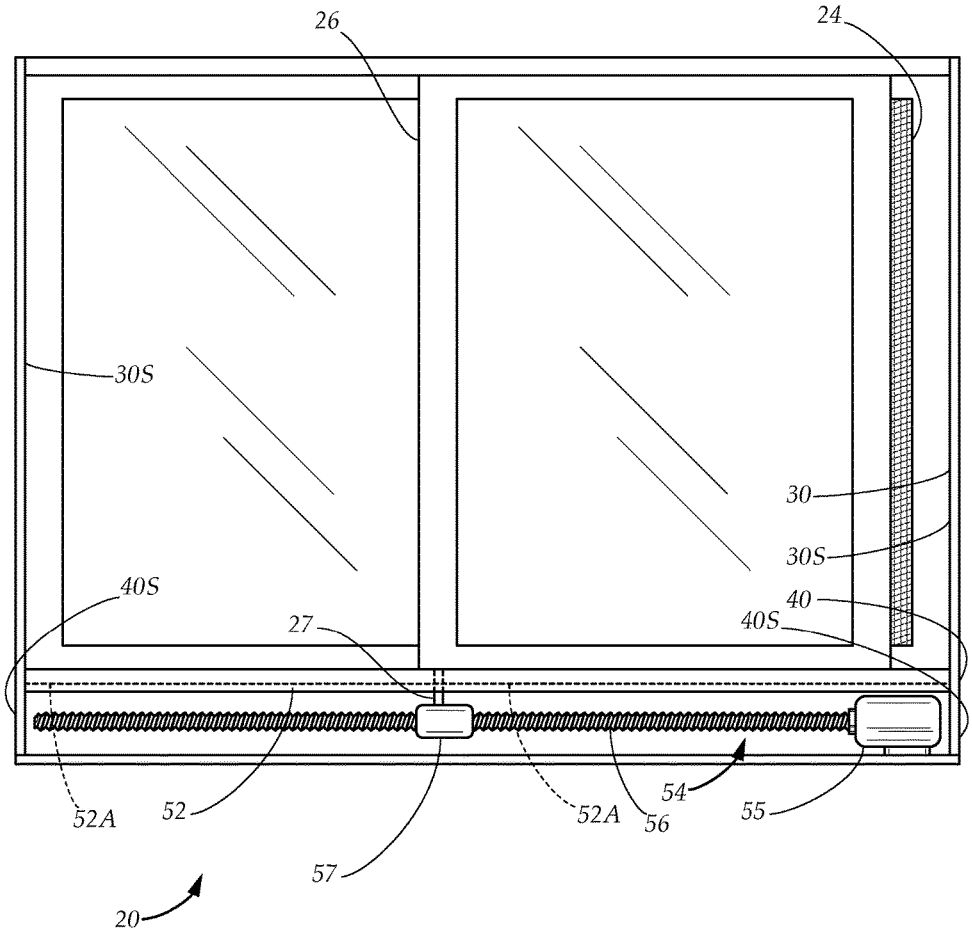
FIG. 7A is a front elevational view with parts broken away, illustrating a panel movement mechanism.
Figure 7B:
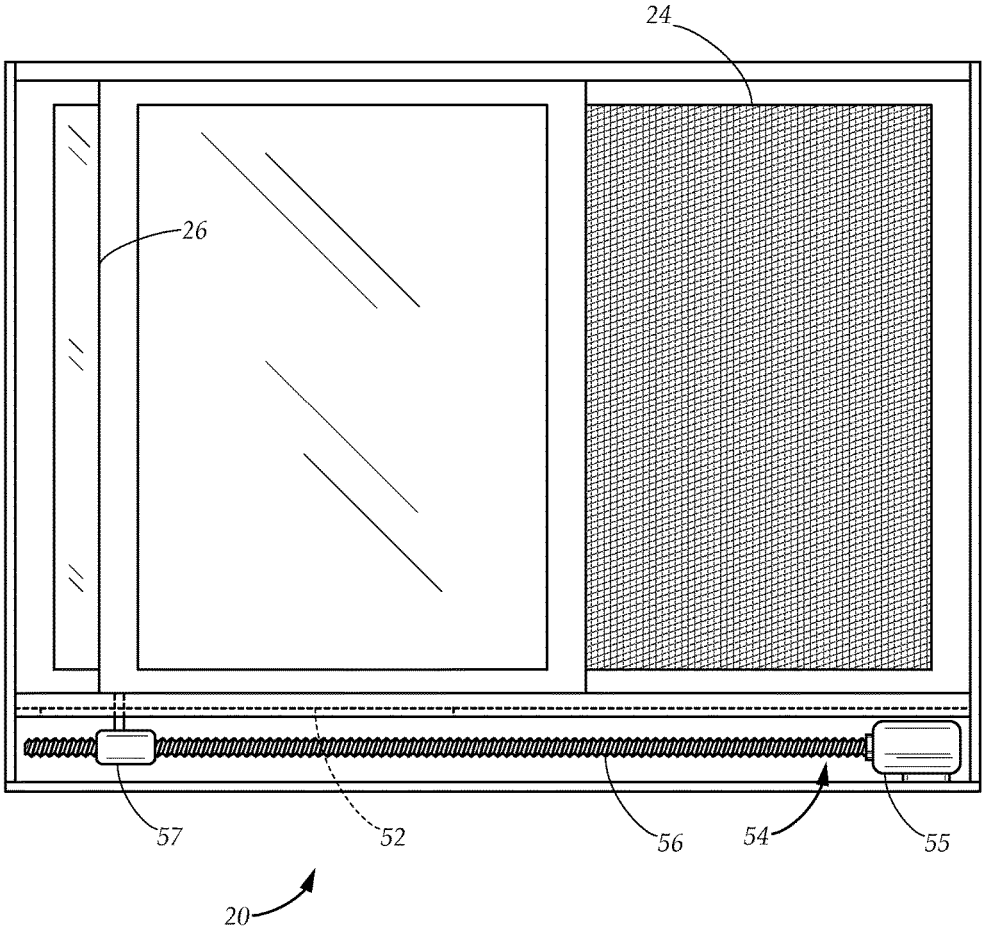
FIG. 7B is a front elevational view with parts broken away, similar to FIG. 7A, except wherein the panel movement mechanism has changed the position of the movable panel.

FIGS. 6, 7A, and 7B illustrate mechanisms and operation of the window venting insert 20 for selectively blocking the screen panel 24 using the solid movable panel 26. In particular, the solid movable panel 26 has a solid movable panel frame 26F having a bottom edge 26FB. A peg 27 protrudes downwardly from said bottom edge 26FB. The lower track 51 has a longitudinal slot 52 having travel limits 52A. The peg 27 extends through the longitudinal slot 52. The lower housing 40 has sides 40S that correspond with the sides 30S of the main housing 30. A motor mechanism 54 includes a motor 55, a threaded rod 56, and an internally threaded carrier sleeve 57. The motor 55 is mounted within the lower housing 40, and the threaded rod 56 extends longitudinally, partially between the sides 40S of the lower housing 40. The carrier sleeve 57 is operably engaged with the threaded rod 56, such that the threaded rod 56 extends through the carrier sleeve 57. The peg 27 is attached to the carrier sleeve 57. Accordingly, when the motor 55 rotates the threaded rod 56, the carrier sleeve 57 is moved longitudinally along the threaded rod 56, in turn moving the peg 27 within the slot. As the peg 27 is moved within the slot, the solid movable panel 26 is moved between the sides 30S of the main housing 30. Thus, reducing or preventing air flow through the screen panel 24 is accomplished by altering the position of the solid movable panel 26 to partially or fully block the screen panel 24. For example, in FIG. 7A, the solid movable panel 26 has nearly reached a closed position, wherein the solid movable panel 26 is fully blocking the screen 24. And in FIG. 7B, the solid movable panel 26 has nearly reached an open position, wherein the solid movable panel 26 is nearly clear of the screen panel 24, such that it does not block the screen panel 24 and therefore does not prevent air flow therethrough. Such positions are readily attainable by the control unit by operating the motor mechanism 54 to move the solid movable panel 26 as needed.

Figure 8:
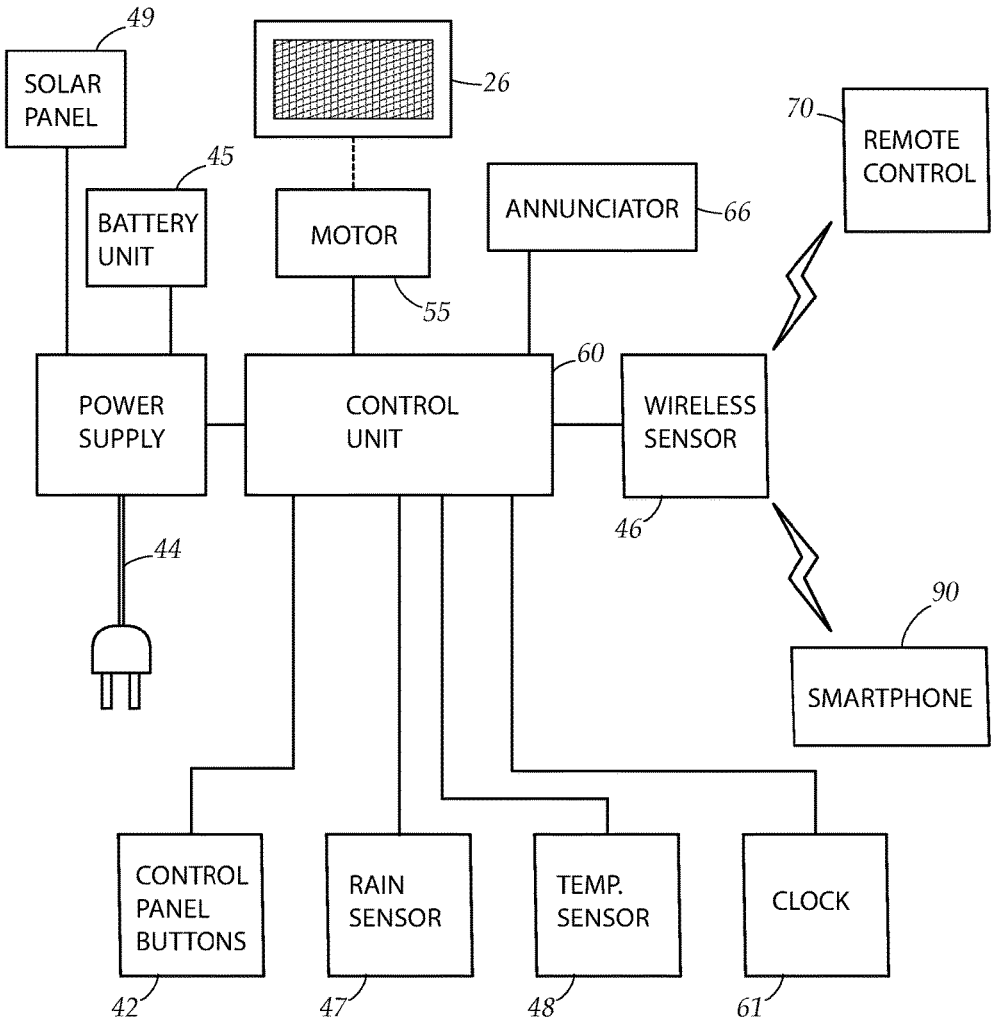
FIG. 8 is a functional block diagram, illustrating the interconnection of functional components of the window venting insert.

FIG. 8 illustrates the interconnection of functional components of the window venting insert 20. In particular, the control unit 60 facilitates, orchestrates, and provides the functionality described herein, and has a clock 61 connected thereto to keep track of the current time of day. The clock 61 may obtain or be set with the current time of day using the control panel buttons 42 and also by determining network time through the wireless sensor 46. The rain sensor 47, temperature sensor 48, and control panel buttons 42 are all connected to the control unit 60 to allow user operation, sense the environment, and act appropriately. The motor 55 is connected to the control unit 60 to allow the control unit 60 to open and close the movable solid panel 26. An annunciator 66, such as a speaker, light array, LED display, or the like, may be also connected to the control unit 60 to provide feedback to the user when setting a closing time, a closing temperature, and the like using the control panel buttons 42.

Figure 9A:
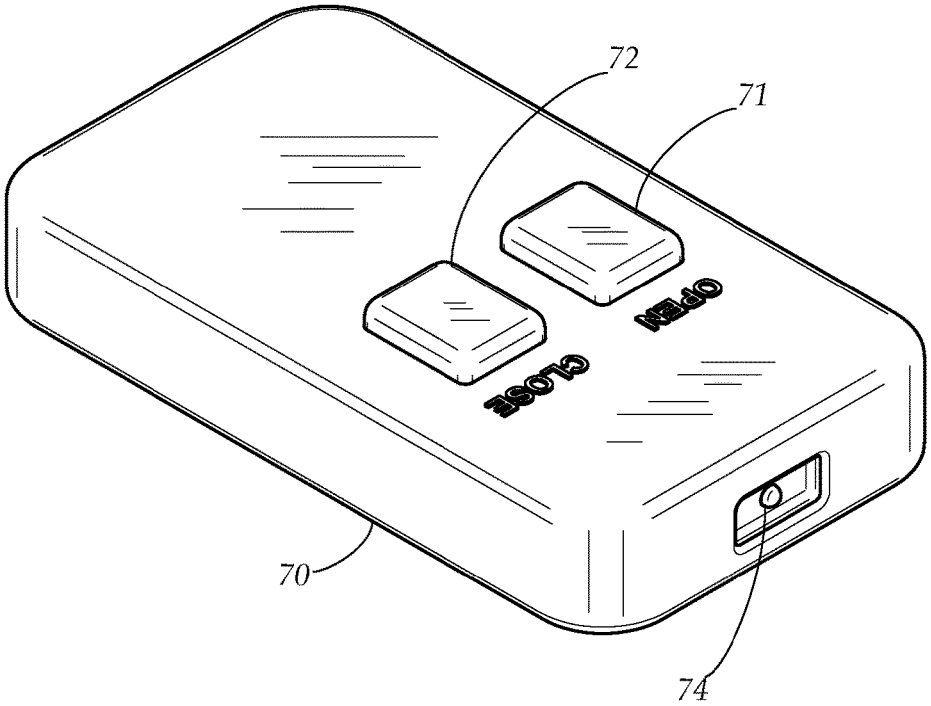
FIG. 9A is a diagrammatic perspective view, showing a remote control configured for use with the window venting insert.
Figure 9B:
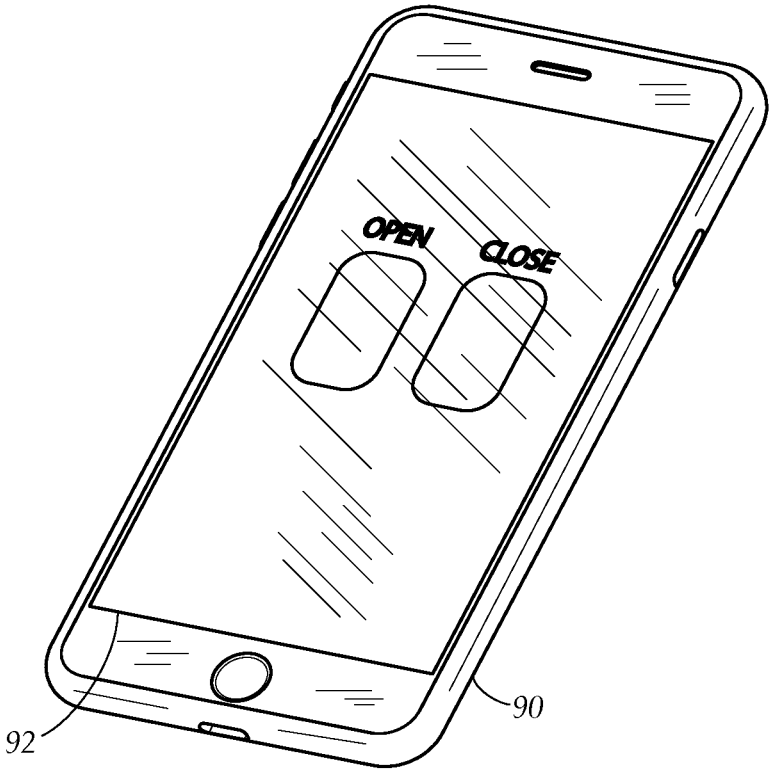
FIG. 9B is a diagrammatic perspective view, illustrating a smartphone having an app for operating the window venting insert.

The wireless sensor 46 is connected to the control unit 60 and allows external control of the window venting insert 20. In particular, referring to FIG. 9A, a remote control unit 70 has an open button 71, a close button 72, and a remote emitter 74. When the open button 71 or close button 72 is pressed on the remote control unit 70, appropriate infrared signals are generated by the remote emitter 74, and received by the control unit (FIG. 8) to operate the motor 55 in response thereto. In addition, referring to FIG. 9B, a smartphone 90 is shown having a touchscreen display 92. The smartphone is running an app configured to allow control of the window venting insert via a wireless connection. In particular, the smartphone 90 generates RF signals that are received by the wireless sensor 46 (FIG. 8) for operating the motor 55. In addition, two way communication may be provided with the smartphone 90, such that the information from the control unit, such as temperature, window position, and settings such as set time and set temperature, may be provided to the smartphone 90, and to the user using the touchscreen display 92. Accordingly, using the smartphone 90, the user may open and close the window venting insert, and set the closing time and closing temperature so that the control unit will operate accordingly.

Figure 8A:
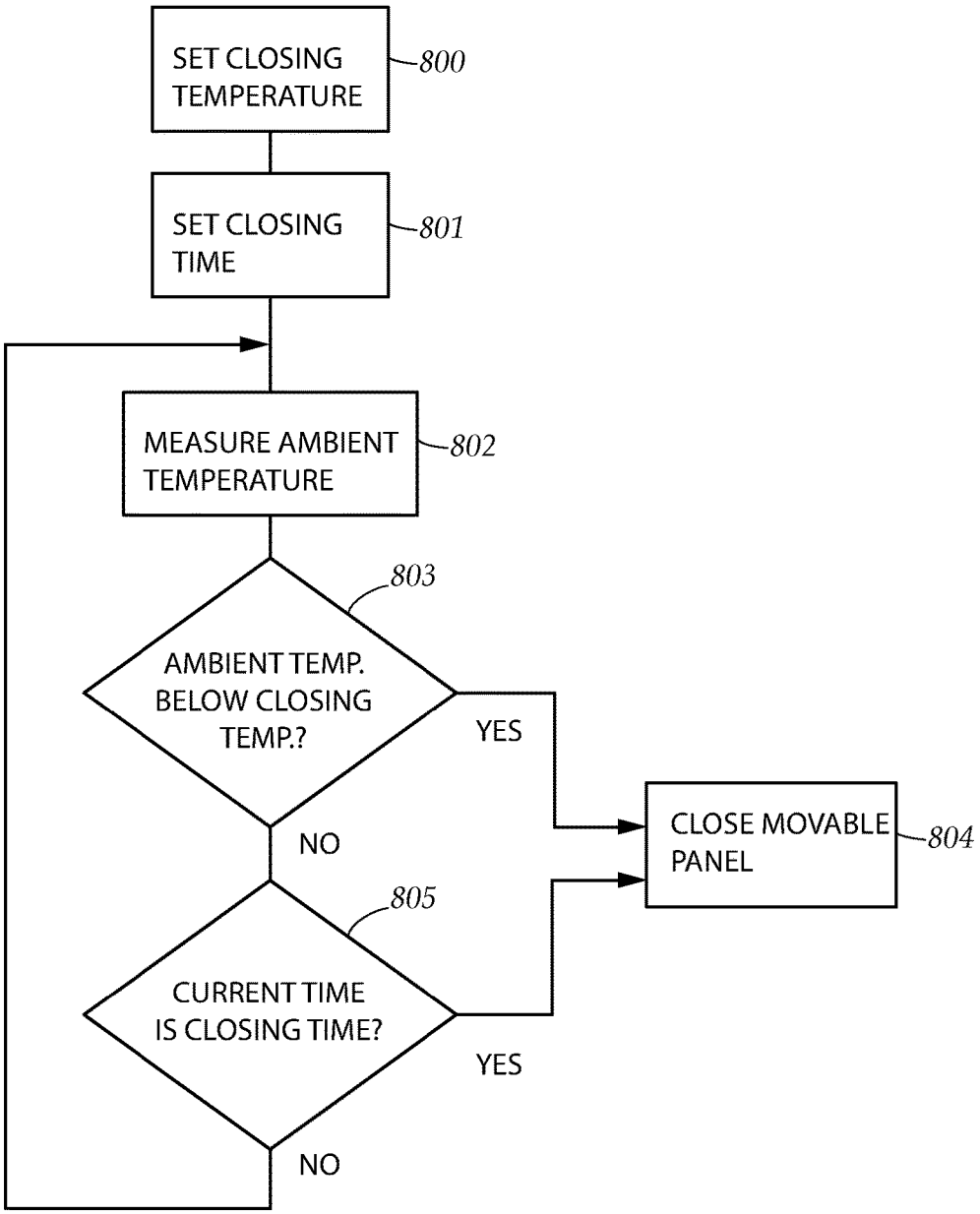
FIG. 8A is a flow diagram, illustrating operative steps in the operation of the window venting insert.

Referring now to FIG. 8A, general operation of the window venting insert is described. In particular, initially the user may set a closing temperature 800. The user may also set a closing time 801. For example, the user may set a closing time that is an hour before his or her waking time. Then, as time passes, using the temperature sensor the system will measure the ambient temperature 802 outside the dwelling and determine if the ambient temperature is below the set closing temperature 803. If it is, the control unit will close the movable panel 804. If not, the system will determine if the current time is the set closing time 805. If it is, the control unit will close the movable panel 804. If neither condition is satisfied at 803 or 805, the system will again measure the outside temperature 802 and repeat through the passage of time.

Figure 14:
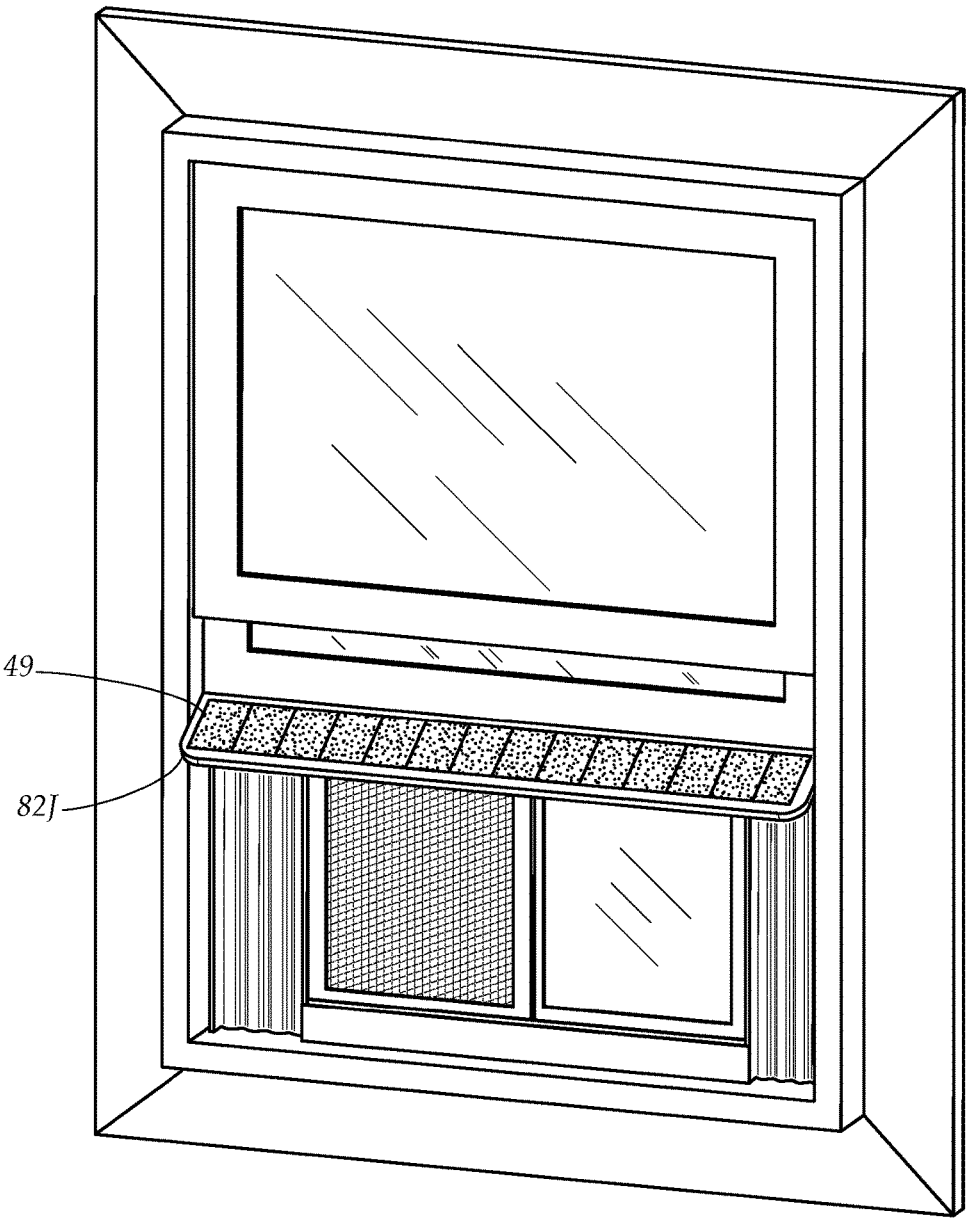
FIG. 14 is a diagrammatic perspective view, showing the window venting device mounted within the window frame, showing exterior features thereof.
Figure 16:
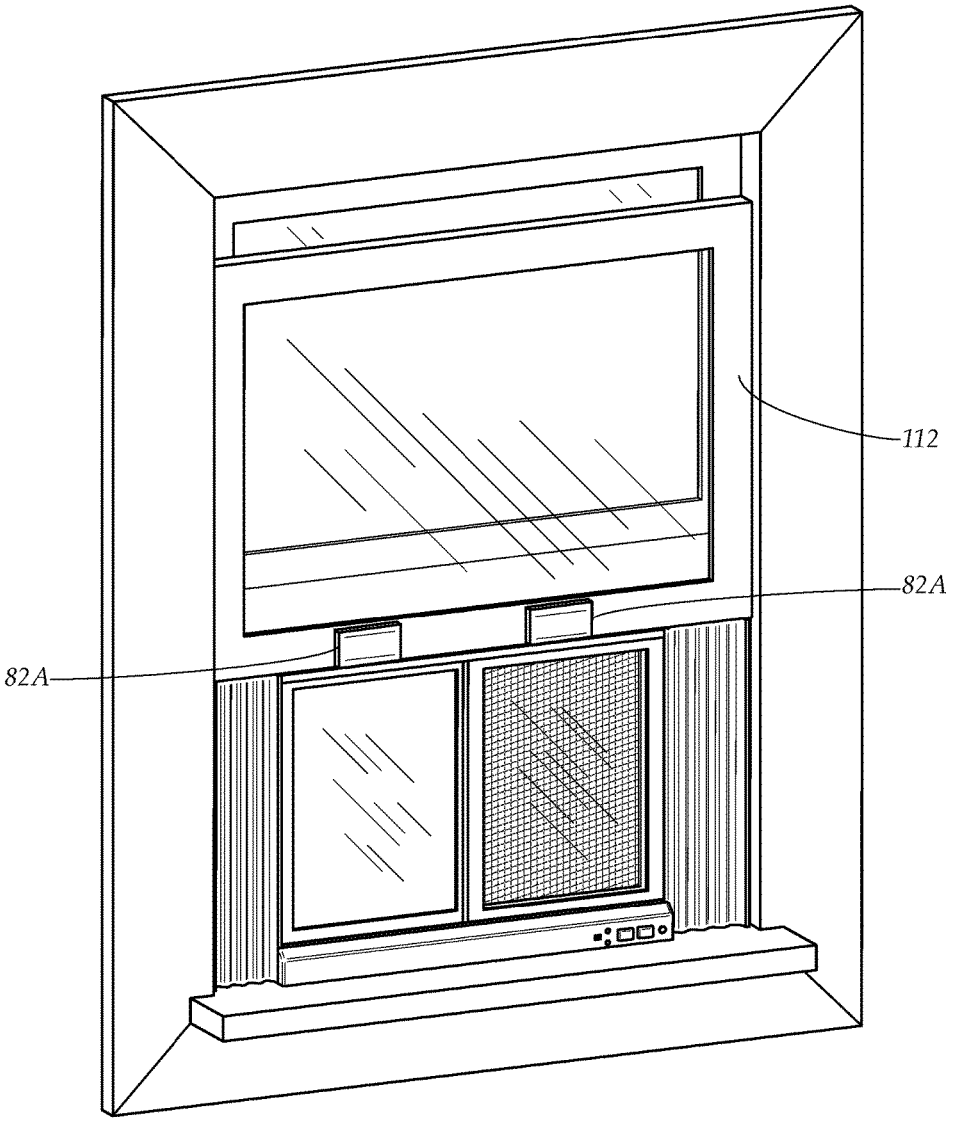
FIG. 16 is a diagrammatic perspective view, showing an embodiment where the window venting insert has protector panels that further sure the insert within the window.
Figure 17:
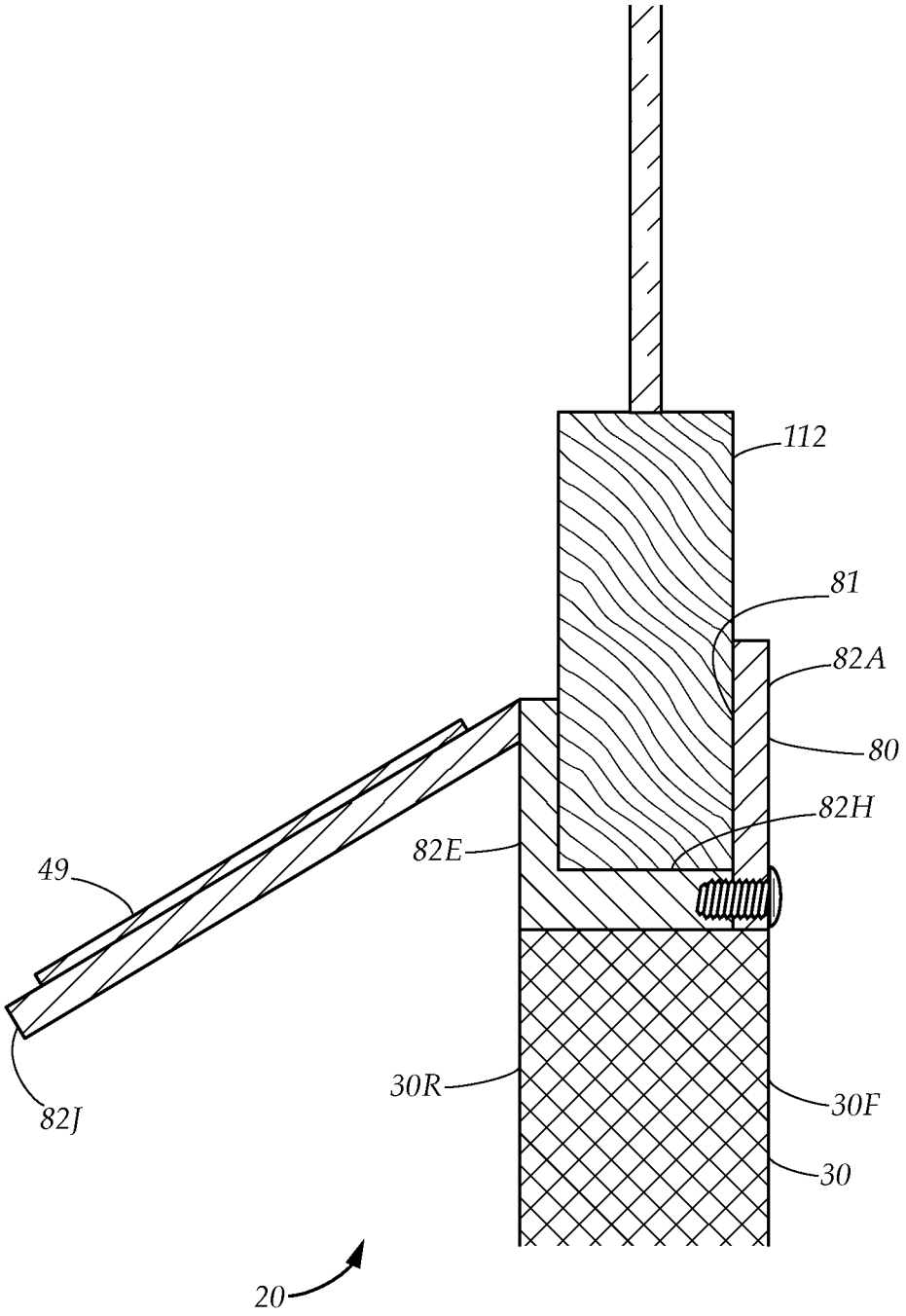
FIG. 17 is a side elevational view, with parts broken away, illustrating the insert installed to a window frame, and showing one of the protector panels installed onto the protector sleeve.

Additional features of the window venting insert may be provided to enhance security and/or ameliorate safety/burglary/theft concerns that might arise regarding keeping the window open for using the device. In particular, referring to FIG. 16 and FIG. 17, a protector device 80 provides a channel 81 for accommodating the lower window panel 112. The protector device 80 includes a horizontal portion 82H, an exterior protector panel 82E that is fixed to the horizontal portion 82H and extends upwardly at the rear 30R of the main housing 30, and an interior protector panel 82A that selectively fastens to the horizontal portion 82H at the front 30F of the main housing 30 after the lower window panel 112 is positioned against/upon the horizontal portion 82H. When in place, the interior protector panel 82A thereby holds the lower window panel 112 and prevents the window venting insert 20 from being pushed inwardly. Note that the exterior protector panel 82E provides a further option for positioning the solar panel 49. In, particular, referring simultaneously to FIG. 14 and FIG. 17, a sky-facing panel 82J is angled to extend outwardly and downwardly from the exterior protector panel 82E and the solar panel 49 is mounted thereon to maximize exposure to the sun.

Figure 15:
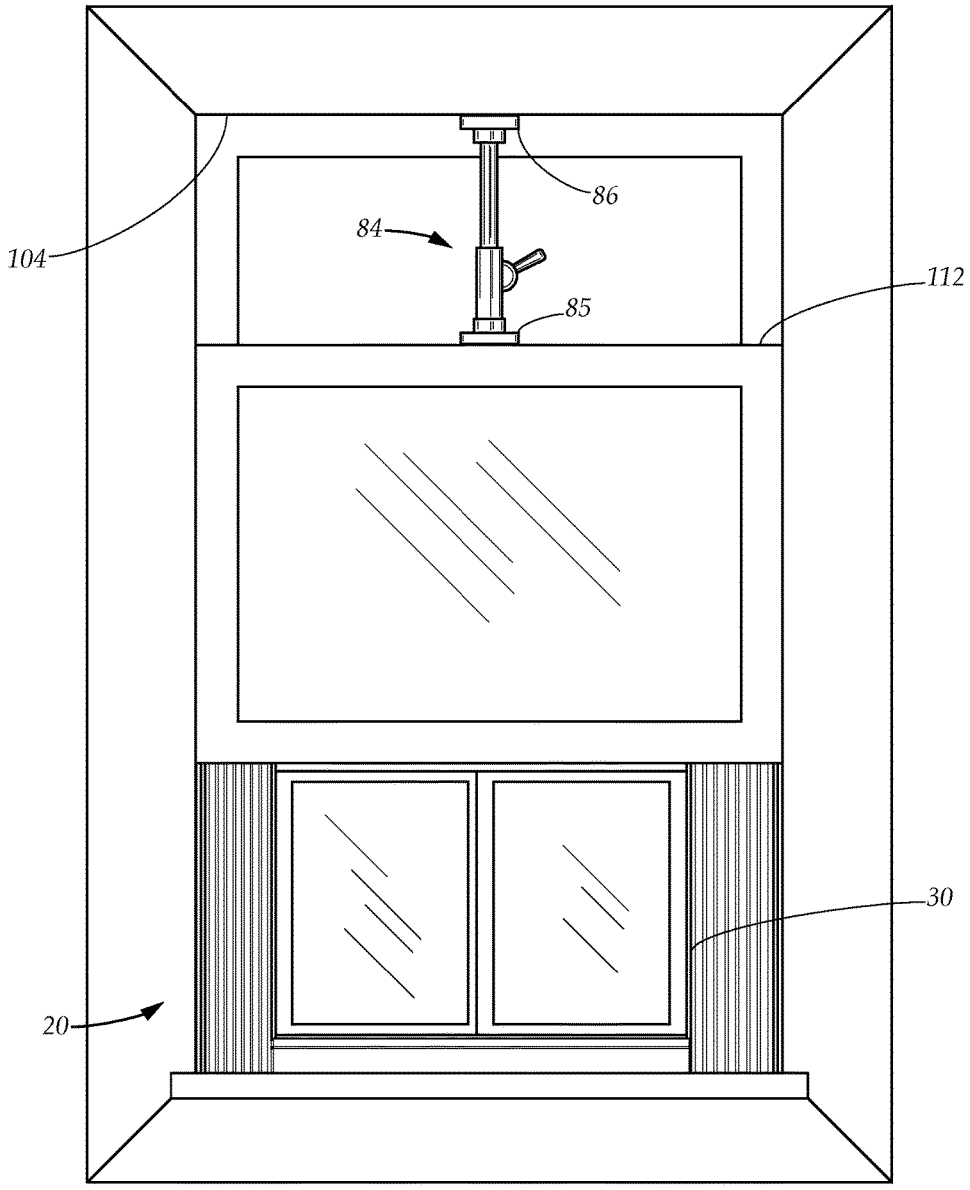
FIG. 15 is a diagrammatic perspective view, showing a jack feature of the window venting device that secures the window while the window venting device is installed and in use.

Further adaptation to aid security is shown in FIG. 15, where the window venting insert 20 includes a jack 84 that has a base 85, a platform 86, and a mechanism for raising and lowering the platform 86 with respect to the base and fixing their relative position. Such mechanisms are well known within the automotive arts and need not be described in detail herein. The jack includes jack handle 87 for actuating the jack, namely—raising, lowering, and holding in position. The jack 84 is adapted to be positioned snugly between the lower window panel 112 and the casement top 104 for securing the lower window panel 112 while the main housing 30 extends within the window opening. With the jack in place, the lower window panel 112 cannot be moved vertically, and therefore a would-be wrongdoer cannot take advantage of the open window as an opportunity for burglary of the dwelling.

Figure 10:
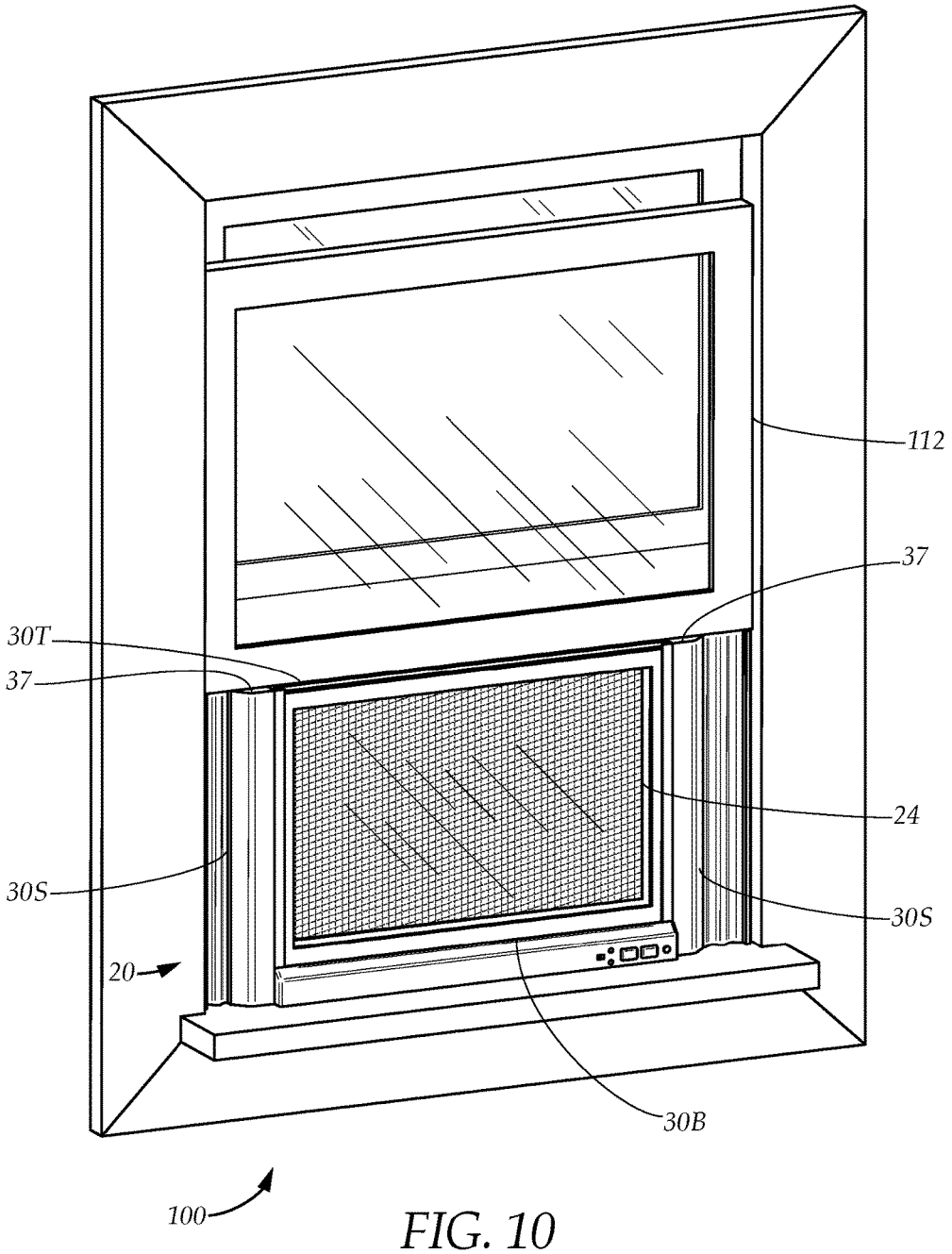
FIG. 10 is a diagrammatic perspective view, illustrating a second embodiment of the window venting insert, having a movable panel that is shown positioned fully in front of the screen panel.
Figure 11:
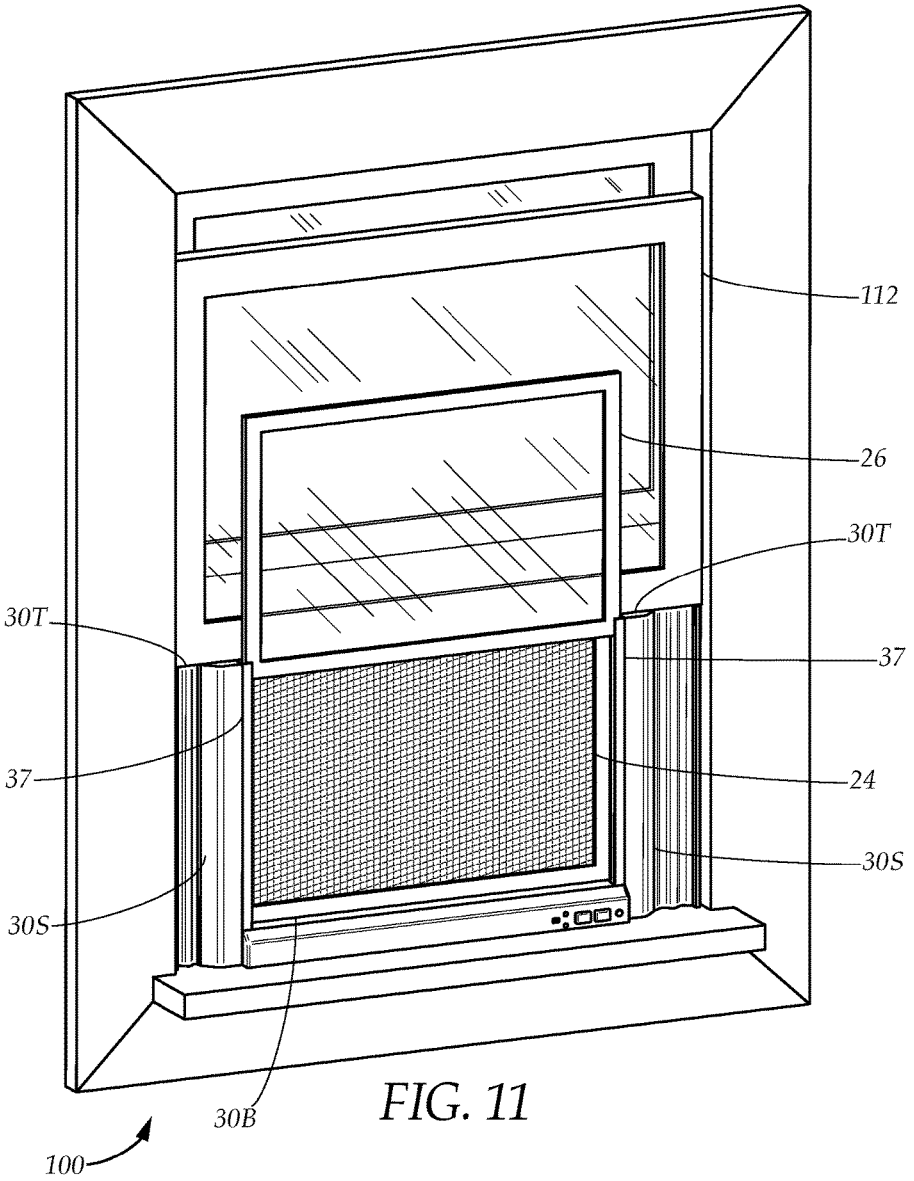
FIG. 11 is a diagrammatic perspective view, similar to FIG. 10, except wherein the movable panel has been fully deployed upwardly to allow ventilation through the screen panel.
Figure 11A:
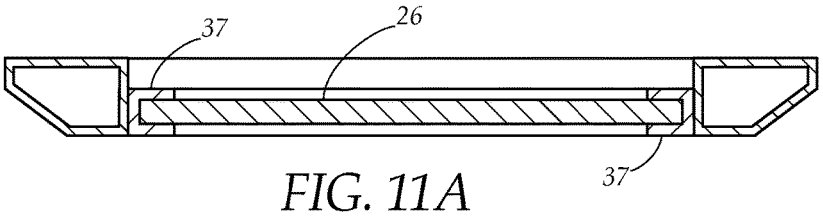
FIG. 11A is a top plan view, with parts broken away, illustrating a portion of the movable panel assembly.

FIG. 10, FIG. 11, and FIG. 11A, show a further embodiment of the window venting insert 20. The screen panel 24 extends fully between the top 30T, bottom 30B, and sides 30S of the main housing 30. The main housing 30 has side tracks 37 that extend vertically at the sides 30S of the main housing, between the top 30T and bottom 30B. The side tracks 37 are open at the top 30T. The movable solid panel 26 extends within the side tracks 37 for vertical movement therein. In particular, in this embodiment the movable solid panel 26 has a closed position where it is aligned directly in front of the screen panel 24 (see FIG. 10), and an open position wherein it is deployed vertically, extending above the top 30T of the main housing 30, and in front of the window lower panel 112 (see FIG. 11). Accordingly, in positioning the window venting device 20 within the window assembly 100, it is important that the side tracks 37 are positioned forward of the window lower panel 112 as seen in FIG. 11 and FIG. 12.

Figure 12:
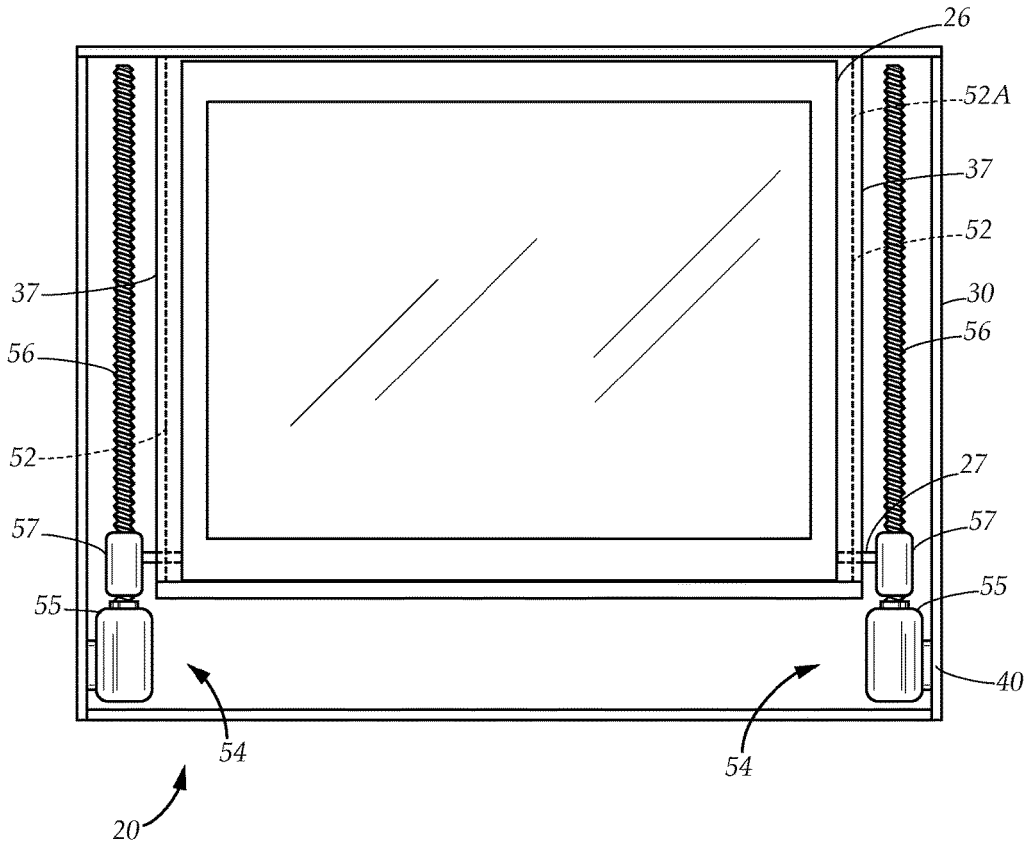
FIG. 12 is a front elevational view, with parts broken away, illustrating an embodiment of the movement mechanism.
Figure 13:
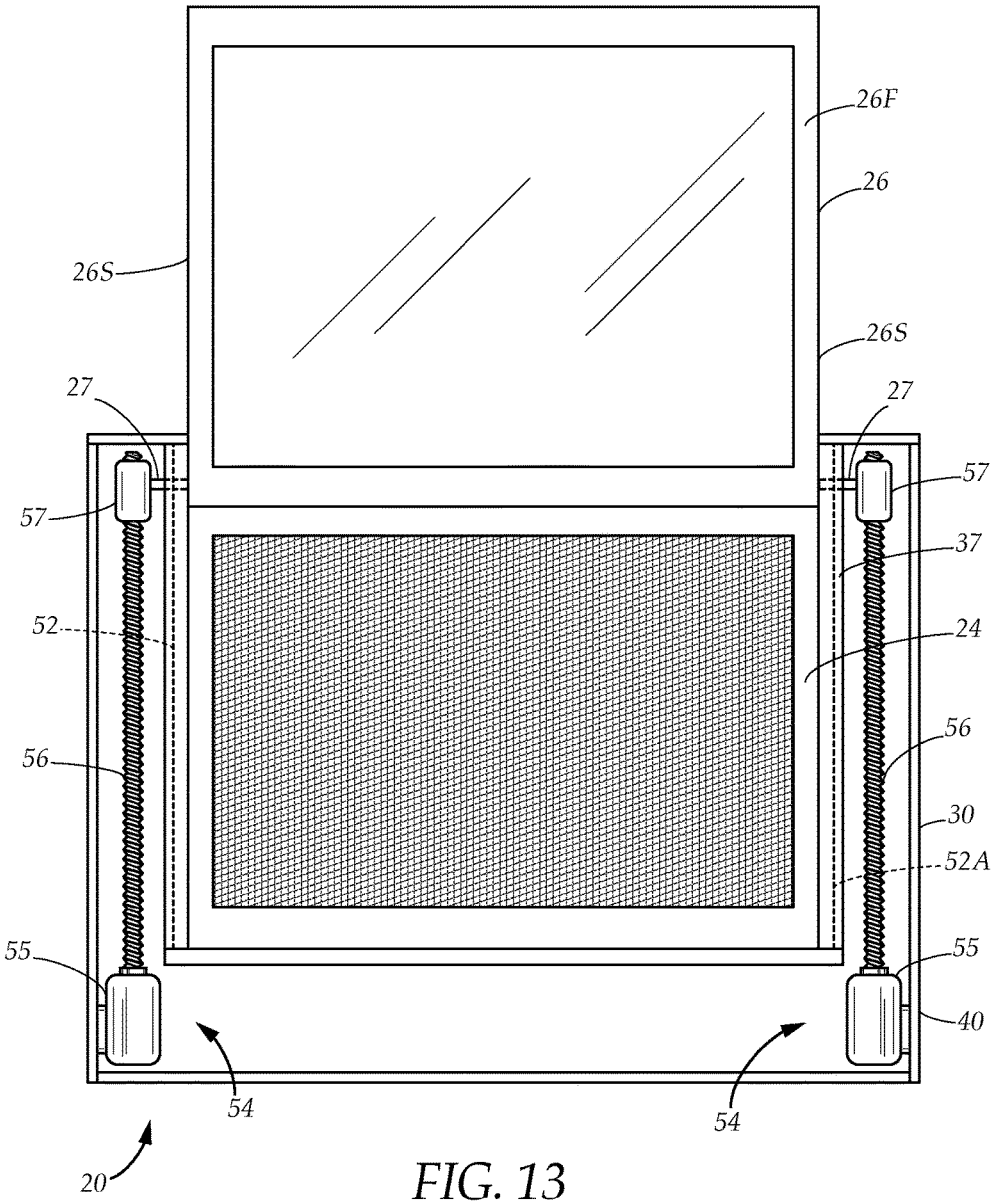
FIG. 13 is a front elevational view, similar to FIG. 12, except wherein the movable panel is in its fully deployed position.

FIG. 12 AND FIG. 13 illustrate mechanisms and operation of the second embodiment of the window venting insert 20 for selectively blocking the screen panel 24 using the solid movable panel 26. In particular, the solid movable panel 26 has a solid movable panel frame 26F having side edges 26S. A pair of pegs 27 each protrudes laterally from one of said side edges 26S. The side tracks 37 each have a longitudinal slot 52 having travel limits 52A. Each peg 27 extends through one of the longitudinal slots 52. A pair of motor mechanisms 54 each include a motor 55, a threaded rod 56, and an internally threaded carrier sleeve 57. The motor 55 is mounted within the lower housing 40, and the threaded rod 56 extends vertically within the main housing 30 behind the side tracks 37. The carrier sleeve 57 is operably engaged with the threaded rod 56, such that the threaded rod 56 extends through the carrier sleeve 57. Each peg 27 is attached to one of the carrier sleeves 57. Accordingly, when the motor 55 rotates the threaded rod 56, the carrier sleeve 57 is moved longitudinally along the threaded rod 56, in turn moving the peg 27 within the slot 52. As the peg 27 is moved within the slot 52, the solid movable panel 26 is moved vertically within the side tracks 37 between the open position seen in FIG. 13 and the closed position seen in FIG. 12. Thus, reducing or preventing air flow through the screen panel 24 is accomplished by altering the position of the solid movable panel 26 to partially or fully block the screen panel 24. For example, in FIG. 12, the solid movable panel 26 has nearly reached the closed position, wherein the solid movable panel 26 is fully blocking the screen 24 (not shown). And in FIG. 13, the solid movable panel 26 has nearly reached an open position, wherein the solid movable panel 26 is clear of the screen panel 24, such that it does not block the screen panel 24 and therefore does not prevent air flow therethrough. Such positions are readily attainable by the control unit by operating the motor mechanisms 54 to move the solid movable panel 26 as needed.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a window venting insert for allowing a window to provide ventilation and to close automatically when appropriate. The disclosure is illustrated by example in the drawing figures, and throughout the written description. It should be understood that numerous variations are possible, while adhering to the inventive concept. Such variations are contemplated as being a part of the present disclosure.

What is claimed is:

1. A window venting insert, for use in a window casement having a casement top, casement sides, and a casement sill, an upper window panel, a lower window panel capable of moving upwardly to create a window opening between the lower window panel, the casement sides, and the casement sill, comprising:

a main housing having a top, a bottom, a front, a rear, and sides, the top having a top track, the bottom having a bottom track;

a lower housing beneath the main housing, the lower housing having a top, a bottom, and sides, the sides of the lower housing corresponding with the sides of the main housing, the lower housing and main housing adapted for extending between the lower window panel and the casement sill;

a pair of side extenders, each side extender having a sealing member and an accordion panel that extends between one of the sides of the main housing and the sealing member, the side extenders adapted for adjusting to extend between the casement sides and thereby spanning the window opening with the main housing, lower housing and side extenders;

a screen panel extending between the top track and bottom track and fixed in position therein, the screen panel allowing air flow between the front and rear of the main housing;

a movable solid panel extending between the top track and bottom track and movable laterally therein to a closed position wherein the movable solid panel is aligned with the screen panel to block air flow therethrough;

a motor assembly for moving the movable solid panel to the closed position;

a temperature sensor; and a control unit having a closing temperature setting and for operating the motor assembly to move the movable solid panel into a closed position and block air flow through the screen panel when the temperature is below the closing temperature setting.

2. The window venting insert as recited in claim 1, further comprising a clock for maintaining time of day, the control unit having a user settable closing time, the control unit operating the motor assembly to close the solid movable panel and block air flow through the screen panel when the closing time is reached by the clock unit.

3. The window venting insert as recited in claim 2, wherein the top panel has a horizontal portion adapted for resting against the lower window panel, an external protector panel that extends upwardly from the horizontal portion at the rear of the main housing, and an internal protector panel that is selectively attachable to the horizontal portion at the front of the main housing, the internal protector panel adapted for attaching to the horizontal portion once the horizontal portion is resting against the lower window panel for maintaining the lower window panel securely between the external protector panel and internal protector panel.

4. The window venting insert as recited in claim 3, further comprising a fixed solid panel, the fixed solid panel extending between the top track and bottom track alongside the screen panel, the movable solid panel having an open position wherein it is selectively substantially aligned with the fixed solid panel and air flow is allowed through the screen panel.

5. The window venting insert as recited in claim 4, further comprising front panel controls on the lower housing for allowing a user to open, close, and set the closing temperature therewith.

6. The window venting insert as recited in claim 5, further comprising a wireless sensor for allowing wireless external control of the movement of the movable solid panel between the open position and the closed position.

7. The window venting insert as recited in claim 6, wherein the motor assembly includes a threaded rod extending horizontally through the lower housing, a motor axially mounted for rotating the threaded rod, and a carrier sleeve mounted on the threaded rod for moving laterally when the threaded rod rotates; wherein the lower housing has a slot in the track; wherein the movable solid panel has a peg extending downwardly through the slot and engaging the carrier sleeve; when the motor rotates the threaded rod the movable solid panel is moved between the open position and the closed position.

8. The window venting insert as recited in claim 7, further comprising a jack, the jack having a base and a platform, the platform selectively elevated from the base, fixed in position, and released by a jack handle, the jack adapted to be positioned between the lower window panel and the casement top for securing the lower window panel while the main housing extends within the window opening.

9. The window venting insert as recited in claim 8, further comprising a rain sensor mounted on the housing rear for prompting the control unit to close the movable solid panel when moisture is detected.

10. A window venting insert, for use in a window casement having a casement top, casement sides, and a casement sill, an upper window panel, a lower window panel capable of moving upwardly to create a window opening between the lower window panel, the casement sides, and the casement sill, comprising:

a main housing having a top, a bottom, a front, a rear, and sides, the top having a top track, the bottom having a bottom track, the main housing also having a pair of side tracks extending vertically at the housing sides;

a lower housing beneath the main housing, the lower housing having a top, a bottom, and sides, the sides of the lower housing corresponding with the sides of the main housing, the lower housing and main housing adapted for extending between the lower window panel and the casement sill;

a pair of side extenders, each side extender having a sealing member and an accordion panel that extends between one of the sides of the main housing and the sealing member, the side extenders adapted for adjusting to extend between the casement sides and thereby spanning the window opening with the main housing, lower housing and side extenders;

a screen panel extending between the top track and bottom track and fixed in position therein, the screen panel allowing air flow between the front and rear of the main housing;

a movable solid panel extending between the side tracks and movable vertically therein to a closed position wherein the movable solid panel is aligned with the screen panel to block air flow therethrough and an open position wherein the movable solid panel is deployed upwardly above the top of the main housing and adapted to extend in front of the lower window panel such that the movable solid panel does not prevent air flow through the screen panel;

a motor assembly for moving the movable solid panel between the open and closed positions;

a temperature sensor; and a control unit having a closing temperature setting for operating the motor assembly to move the movable solid panel into a closed position and block air flow through the screen panel when the temperature is below the closing temperature setting.

11. The window venting insert as recited in claim 10, further comprising a clock for maintaining time of day, the control unit having a user settable closing time, the control unit operating the motor assembly to close the solid movable panel and block air flow through the screen panel when the closing time is reached by the clock unit.

12. The window venting insert as recited in claim 11, further comprising front panel controls on the lower housing for allowing a user to open, close, and set the closing temperature therewith.

13. The window venting insert as recited in claim 12, further comprising a wireless sensor for allowing wireless external control of the movement of the movable solid panel between the open position and the closed position.

14. The window venting insert as recited in claim 13, wherein the motor assembly includes a pair of threaded rods extending vertically within the main housing behind the side tracks, a pair of motors axially mounted for rotating the threaded rods, and a carrier sleeve mounted on each of the threaded rods for moving laterally when the threaded rods rotate; wherein the side tracks each have a slot; wherein the movable solid panel has a pair of pegs that each extend laterally through one of the slots and engage one of the carrier sleeves; when the motors rotate the threaded rods, the movable solid panel is moved between the open position and the closed position.

15. The window venting insert as recited in claim 14, further comprising a jack, the jack having a base and a platform, the platform selectively elevated from the base, fixed in position, and released by a jack handle, the jack adapted to be positioned between the lower window panel and the casement top for securing the lower window panel while the main housing extends within the window opening.

16. The window venting insert as recited in claim 15, further comprising a rain sensor mounted on the housing rear for prompting the control unit to close the movable solid panel when moisture is detected.

* * * * *